United States Patent [19]

Silbernagel

[11] 4,412,396

[45] Nov. 1, 1983

[54] SIGN HOLDER WITH REVERSIBLE SUPPORTING BRACKETS

[76] Inventor: Hermann Silbernagel, Friesenheimer Strasse 7a, 6800 Mannheim 1, Fed. Rep. of Germany

[21] Appl. No.: 113,110

[22] Filed: Jan. 17, 1980

[30] Foreign Application Priority Data

Oct. 26, 1979 [DE] Fed. Rep. of Germany ... 7930368[U]

[51] Int. Cl.[3] ..... G09F 15/00

[52] U.S. Cl. ..... 40/607

[58] Field of Search ..... 40/606, 607, 10 R

[56] References Cited

U.S. PATENT DOCUMENTS

| | | | |
|---|---|---|---|
| 1,529,752 | 3/1925 | Sprung et al. | 40/607 |
| 1,874,884 | 8/1932 | Bryan et al. | 40/607 |
| 2,025,004 | 12/1935 | Shearer | 40/607 |
| 2,372,111 | 3/1945 | Norberg | 40/607 |
| 2,552,745 | 5/1951 | Stanley et al. | 40/607 |
| 2,559,302 | 7/1951 | Louft | 40/607 |
| 2,819,548 | 1/1958 | Campbell | 40/607 |
| 3,058,246 | 10/1962 | Schoeffler | 40/607 |

FOREIGN PATENT DOCUMENTS

| | | | |
|---|---|---|---|
| 93665 | 3/1969 | France | 40/607 |
| 82833 | 1/1935 | Sweden | 40/607 |

*Primary Examiner*—Robert Peshock
*Assistant Examiner*—Wenceslao J. Contreras
*Attorney, Agent, or Firm*—Staas & Halsey

[57] ABSTRACT

A sign holder having at least one support post over which turnoverable square shaped sign supporting frames are placed, each frame being secured to the post by an adjustable screw threaded through appropriately placed threaded holes on each supporting frame, each supporting frame furthermore having an angle iron integral therewith for engagement with an edge of a sign to be supported by the sign holder, each supporting frame further having projecting holding plates each provided with a bore therein for attachment to a supporting wind brace, and provision included with each supporting frame for attachment of a lamp thereto.

6 Claims, 4 Drawing Figures

SIGN HOLDER WITH REVERSIBLE SUPPORTING BRACKETS

The invention relates to a sign holder comprising at least one post over which is mounted supporting brackets embracing this post and at the front end of which an angle iron is located for retaining an edge of a sign from above or below.

This type of sign holder is, for example, employed for quickly setting up and pulling down a sign at a construction site, particularly on highways. The important point is that the sign holders be so designed that they can be moved about and taken apart. They shall also be capable of bearing signs of varying sizes.

Sign holders are known in which at least one post is set up, over which supporting brackets are placed. Inside, these supporting brackets are provided with a recess having the profile shape of the post. Square profiles are generally employed, that is to say, the post has a square configuration, as has the recess in the supporting bracket. In this case, the supporting brackets have an angle iron at their front end. The sign to be set up is inserted with the edge into this angle iron. In this way, the sign is supported by its bottom edge and is seized by its upper edge by another supporting bracket. Due to its own weight the upper supporting frame tends to settle by its own accord on the upper edge of the sign. At the same time, the entire sign has a strong tendency to squeeze itself into the angle iron of the lower supporting frame. In the past, to prevent the sign from slipping out laterally, wooden wedges were driven in between these angle irons and the sign. In this way, the sign or the edge thereof is clamped into the supporting bracket against the angle iron or irons. The lower supporting bracket was connected through nails with the post to form one piece, that is to say, they were simply nailed down. This type of sign holders with nailed-down supporting brackets are impractical, however, because when the sign is knocked down, it takes a great deal of time and effort to pull the nails out of the post. Furthermore, nails can only be driven into wooden posts, which is also a disadvantage, because wooden posts rot easily and can therefore be used only for a short time as holding posts for a sign which, of course, must be set up regardless of weather conditions. Therefore, the familiar rust-proof metal posts, which have a virtually unlimited service life, cannot be utilized. Just as cumbersome, as well as unreliable, is the wedging of the sign or the edge thereof into the angle iron by means of wooden wedges. This is old in the art, but a disadvantage is that these wooden wedges expand when the weather is wet and they automatically squeeze themselves out of their wedged position. When the sun shines again, the wooden wedges dry out and at times even drop by their own accord from their position between angle and sign.

Therefore, the primary object of the present invention is to provide an improved supporting bracket of the type of sign holders described above, which makes it possible to also use metal posts of the above type for setting up a sign and which furthermore allows the sign to be clamped in its angle iron. This clamping is absolutely reliable, because it is not subject to atmospheric conditions.

This problem is solved according to the present invention in that on at least one side of the supporting bracket there is arranged a threaded hole into which is screwed a screw for locking this supporting bracket against the post. In a preferred embodiment of the invention, the threaded hole is designed as an external nut which lies on one side of the supporting bracket. This results in a very economical threaded hole, because no screw tap need be used on the finished supporting bracket.

The present inventive idea underlying the supporting bracket according to the invention is based on the principle of gravitational attraction of this supporting bracket, that is to say, the supporting bracket according to the invention is seated on the edge of the sign to be held solely because of its own weight from above, thus preventing the sign from falling out of the supporting bracket embodying the principles of the invention. Further, this gravity principle implies that the sign itself, due to its own weight, presses on the lower supporting bracket and is seated fixedly thereon. Thus, all vertical retaining forces in the mounting stand according to the invention of a traffic sign are produced by the components themselves in cooperation with gravity. Thus, loosening due to aging and wear is ruled out. The fall principle also results in a fast and simple usage and setup of the sign holder and supporting bracket according to the invention, because the maintenance men can likewise use these vertical retaining forces to advantage for the setup. Thus, they must no longer exert mounting forces in the direction of gravity or bring about forces by means of screws and vises.

In various embodiments of the supporting bracket according to the present invention, the threaded hole or the nut may be on the right side, on the left side, and on the rear side of the supporting bracket. The screw for locking the supporting bracket against the post may particularly be provided at its front end with a pressure plate. In this way, the pressure of the screw is transmitted to the post over a wider area, saving the latter. However, it is also possible that not only one, but two sides, of the supporting bracket, e.g. the rear side and the left side, are provided with a threaded hole or nut bearing the latter for the purpose of carrying a screw for locking the supporting bracket. Finally, it is conceivable that all four sides of the supporting bracket are constructed in this manner. The screw for locking the supporting bracket is arranged in the threaded hole of the nut or is screwed thereinto. When the supporting bracket bears more than two screws, posts can also be used whose dimensions are substantially smaller than those of the inner span of the supporting bracket for the setup or formation of the sign holder according to the invention. Even the spacing of the supporting bracket within the free inner span of the supporting bracket according to the invention can be varied by means of the individual screws.

In a further preferred embodiment, the threaded hole or the nut may also be arranged on the front side of the supporting bracket according to the invention. For this purpose, the angle iron is arranged approximately at half the height of the front side of the supporting frame; in this way, there is sufficient space for the threaded hole or nut, as the case may be.

It is convenient to provide the supporting bracket according to the invention with rearwardly protruding holding plates both on the right and on the left side, in which bores are drilled. In this way, a wind brace can be mounted directly on the supporting bracket in order to prop up the post. Thus, independent fastening of the wind brace to the post, separate from the supporting bracket, becomes unnecessary. Because the screw locks the supporting bracket into position on the post, the supporting bracket is also capable of transfer from the post to the wind brace.

In a further embodiment, the supporting bracket according to the invention further has a projecting arm on the right or left side. At the end of this arm, a square iron is arranged at right angles thereto. Preferably, this square iron is mounted in such a way as to run parallel to the post, especially upwards. It serves to carry a lamp provided with a supporting facility which fits the square iron. Such a lamp is, for example, known and described in West German Utility Model No. 77 14 569.

In the angle iron itself, a threaded hole or a nut mounted on the outer surface of the angle iron may also be provided to ensure perfect locking or wedging of the sign in the angle iron of the supporting bracket according to the invention. In this threaded hole or nut, a screw can be turned to the sign, clamping the latter.

Advantageously, the angle iron is sloped slightly outwardly away from the front. When a sign is inserted from above into such a sloping angle iron, it is automatically wedged in the angle iron due to a wedging action; the pressure of the sign against the sloping angle iron is simply brought about by the sign's own weight. Thus, there can be no risk whatever that the sign becomes loose, because when the dimensions of the angle iron are changed for any reason at all, the sign will continue to be automatically pressed by its own weight into the clamping position.

Preferably (see FIG. 4), the screw is provided with a pressure plate at its end turned toward the post. This results in better adhesive power and pressure distribution over the post. Particularly, the surface of the post is saved, because the pressure is distributed over a wider area. Finally, the pressure plate may also be provided with one or more spikes, which can be fixedly buried in a wooden post, thus preventing the supporting bracket according to the invention from sliding even on wet wood.

An embodiment of the invention is shown in the figures, wherein:

FIG. 1 shows a supporting bracket according to the invention, having on its right side (2) a threaded hole (6) in the form of a nut (5).

A square opening is formed by the sides (1), (2), (3), and (4). This closed square opening structure for the bracket is designed to slide over a post of similar square configuration.

Figure 1:
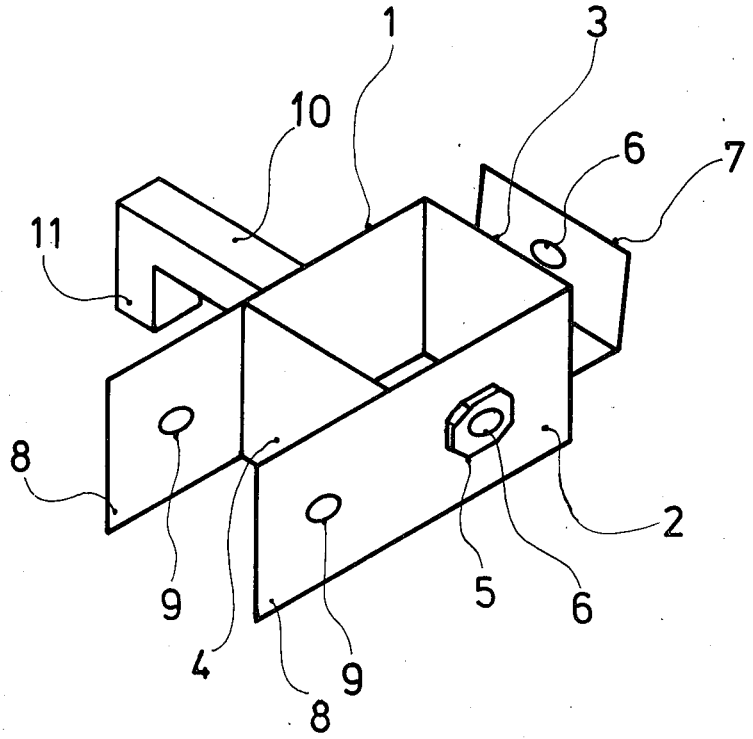
FIG. 1 shows in perspective a supporting bracket embodying the principles of the present invention.

Through this threaded hole (6) a screw must be turned against the post (12), so that the supporting bracket according to the invention is locked thereon. An angle iron (7) is arranged on the front side (3) of the supporting bracket. As apparent from FIG. 1, the angle iron may slope slightly upwards and outwards. It may also have a threaded hole (6), through which a screw (13) can be turned, by means of which the sign (15) is clamped. Also shown in FIG. 1 is the possibility of arranging rearwardly protruding holding plates (8) on the right side (2) and the left side (1). In this way, a wind brace (14) can be suspended with a splint, which is inserted into the bores (9). FIG. 1 also shows the possibility of mounting on one side, here shown on the left side (1), an arm (10) which protrudes from the supporting bracket according to the invention. At the end of this arm (10), a square iron (11) is mounted at right angles thereto. This square iron (11) preferably runs parallel to the left side (1) and to the rear side (4), i.e., the square iron (11) preferably runs parallel to the post (12) of the sign holder. In this square iron, a lamp can be inserted with the object of illuminating the sign. The lamp has a suitable supporting facility. This type of lamp is exemplified by West German Utility Model No. 77 14 569.

Figure 2:
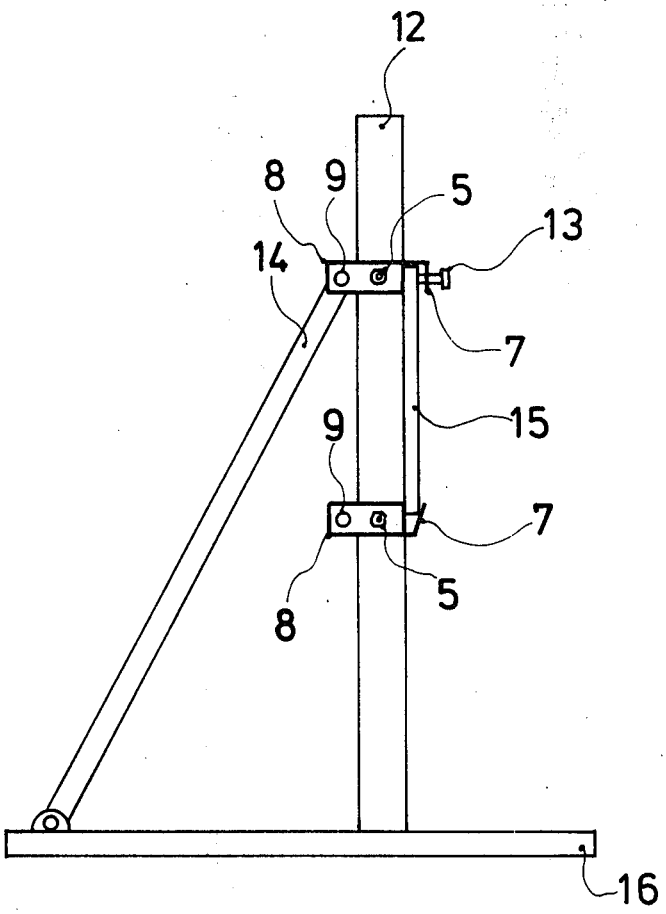
FIG. 2 is an overall view from the side of a sign holder provided with the supporting bracket according to the invention.

FIG. 2 is a side view of a sign holder equipped with the bracket supporting according to the invention. The post (12) is mounted on a foot (16). On the lower edge of the sign (15) there is mounted a supporting bracket according to the invention, having a slightly upwardly sloping angle iron (7). The sign (15) is automatically clamped by its own weight in the angle iron. The supporting brackets are locked by screws against the post (12); the screws themselves are not visible in this Figure (2), but the nuts (5) are shown on the sides of the supporting bracket. The holding plates (8), in which bores (9) are drilled, are clearly visible. They protrude rearwardly from the supporting bracket according to the invention. A wind brace (14) is mounted on the holding plates (8) of the upper supporting bracket. This can be done by suspending the wind brace (14) in a splint (not shown), which is inserted into the bores (9). The other end of the wind brace (14) is affixed to the foot (16). The upper supporting bracket in FIG. 2 has a screw (13) in the angle iron (17), by means of which the sign (15) is clamped. Not shown is a nut which makes available the thread for the screw (13) in the angle iron (7) of the upper supporting brackets. The screws themselves are not shown in detail in FIG. 2; they are located in the threaded holes (6) of the nuts (5) on the sides of the supporting bracket according to the invention. The nut (5) in the supporting bracket which seizes the sign (15) from below, as shown in FIG. 2, is situated on the right side. In the supporting bracket which seizes the sign (15) on the upper edge by the screw (13) has the nut (5) for locking the supporting bracket on the post (12) on the left side when referred to FIG. 1.

Figure 3:
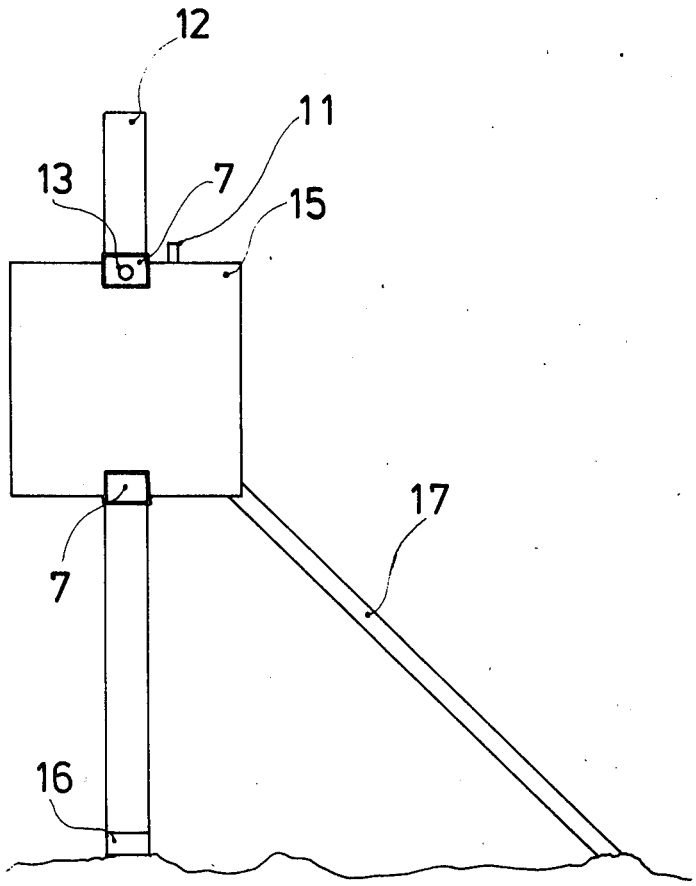
FIG. 3 is a front elevational view of a sign holder provided with the supporting bracket according to the invention.

Finally, FIG. 3 is a front elevational view of a sign holder according to the invention which is provided with supporting bracket according to the invention. A prop (17) is visible on the side, which guards the sign against lateral tipping. Under certain conditions, this prop (17) may also be fastened to the holding plates (8) with the bores (9) thereof as protruding rearwardly from a supporting bracket according to the invention. A square iron (11) projecting upwardly from behind the sign (15) is visible in FIG. 3. As already explained with reference to FIG. 2, a lamp may be inserted in this square iron (11) to illuminate the sign. According to the invention, a sign holder may also have more than two posts (12). Sign holders are preferred with two posts (12) arranged side by side. The sign (15) is retained or clamped on these two posts (12) from below or above by supporting brackets according to the invention. Two such juxtaposed posts (12) may be braced in a known manner to impart the requisite rigidity to the sign holder.

However, since the supporting brackets according to the invention assure a very strong positive coupling of the sign (15) with the post (12), such bracing of several posts (12) may be dispensed with if supporting bracket according to the invention are employed.

Figure 4:
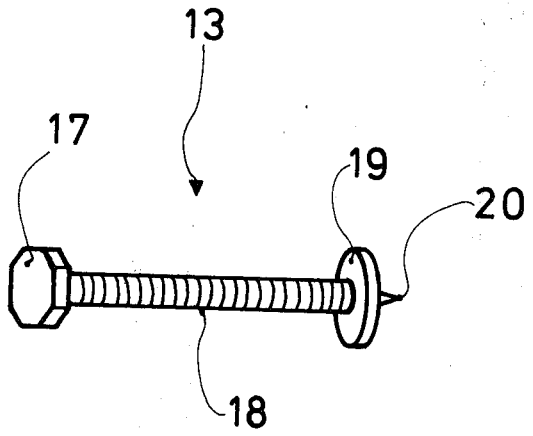
FIG. 4 is a perspective view of a screw per se for the supporting bracket according to the invention.

FIG. 4 shows a preferred screw (13) for locking the supporting bracket on the post (12). This screw (13) has on its front side a pressure plate (19). A forwardly projecting spike (20) is mounted through the pressure plate. This spike may be buried in a wooden post (12), so that the supporting frame according to the invention is prevented from sliding along the post (12). Reference numeral (18) denotes the threads of the screw (13). The screw carries a head (17) on its rear end. In the figure, it is shown as an octagonal head. Other head shapes, e.g. a hexagonal head, may also be used. A screw with a hexagonal head shall preferably first be constructed with the head (17) or the pressure plate (19) by forging, after which it is screwed with the thread (18) into the threaded hole (6).

LEGEND

1—left side
2—right side
3—front side
4—rear side
5—nut
6—threaded hole
7—angle iron
8—holding plate
9—bore
10—arm
11—square iron
12—post
13—screw
14—wind brace
15—sign
16—foot
17—head
18—thread
19—pressure plate
20—spike

I claim:

1. A sign holder comprising:

at least one post of square shaped cross-section, over which several reversible supporting brackets each having a square shaped opening therethrough are placed which embrace said post;

each said square shaped opening supporting bracket having at the front thereof an angle iron for holding an edge of a sign from either above or below;

each said supporting bracket further having on at least one side thereof a threaded hole, more particularly in the form of an external nut provided on the outside of the supporting frame in which a screw can be threaded, said screw being turned into engagement with the post so as to lock each supporting bracket thereto, and at least one bracket having said angle iron sloped slightly outwardly away from the front of said supporting bracket so that when said at least one bracket is used to hold an edge of a sign from below the weight of the sign effects a wedging action with said bracket.

2. A sign holder according to claim 1, wherein a threaded hole is positioned on the front of each of said square shaped opening supporting frames underneath the angle iron thereof which is approximately half the weight of the front of the supporting bracket.

3. A sign holder according to claim 1, wherein each supporting bracket is provided with rearwardly protruding retaining plates each having a bore therein for attachment of a wind brace thereto, each plate protruding from one side of the square shaped supporting bracket.

4. A sign holder according to claim 1, wherein on one side or the other of each supporting bracket there is mounted a projecting arm, each said projecting arm being provided at the end thereof with a square iron which is disposed at right angles thereto.

5. A sign holder according to claim 1, wherein there is arranged on the angle iron a threaded hole, more particularly in the form of a threaded nut lying on the outer surface of the angle iron, and a screw being threaded therethrough for wedging a sign against the support bracket.

6. A sign holder according to claim 1, wherein a threaded hole is positioned on the rear of each of said square shaped opening supporting brackets.

* * * * *